US011270591B2

(12) United States Patent
Amacker

(10) Patent No.: US 11,270,591 B2
(45) Date of Patent: Mar. 8, 2022

(54) VEHICLES AS TRAFFIC CONTROL DEVICES

(71) Applicant: TOYOTA RESEARCH INSTITUTE, INC., Los Altos, CA (US)

(72) Inventor: Matthew Amacker, Santa Clara, CA (US)

(73) Assignee: TOYOTA RESEARCH INSTITUTE, INC., Los Altos, CA (US)

( * ) Notice: Subject to any disclaimer, the term of this patent is extended or adjusted under 35 U.S.C. 154(b) by 213 days.

(21) Appl. No.: 16/267,075

(22) Filed: Feb. 4, 2019

(65) Prior Publication Data

US 2020/0250989 A1 Aug. 6, 2020

(51) Int. Cl.
*G08G 1/00* (2006.01)
*G08G 1/01* (2006.01)

(52) U.S. Cl.
CPC ..... *G08G 1/205* (2013.01); *G08G 1/0112* (2013.01); *G08G 1/0145* (2013.01)

(58) Field of Classification Search
None
See application file for complete search history.

(56) References Cited

U.S. PATENT DOCUMENTS

| | | | | |
|---|---|---|---|---|
| 7,425,903 | B2 * | 9/2008 | Boss | G08G 1/162 340/902 |
| 9,494,943 | B2 * | 11/2016 | Harvey | B60Q 1/50 |
| 2005/0018444 | A1 * | 1/2005 | Todd | B60Q 7/00 362/545 |
| 2008/0023507 | A1 * | 1/2008 | Uebler | B62D 43/005 224/42.2 |
| 2017/0217588 | A1 * | 8/2017 | Spinelli | G08G 5/0069 |
| 2018/0144628 | A1 * | 5/2018 | Nicholson | G08G 1/0955 |
| 2019/0019408 | A1 * | 1/2019 | Beaulieu | G08G 1/07 |
| 2020/0242922 | A1 * | 7/2020 | Dulberg | G08G 1/08 |
| 2021/0170941 | A1 * | 6/2021 | Singh | F21S 41/25 |

FOREIGN PATENT DOCUMENTS

| | | | |
|---|---|---|---|
| DE | 102009052589 | A1 | 5/2011 |
| DE | 102014226254 | A1 | 6/2016 |

OTHER PUBLICATIONS

Stewart, "It Takes a Single Autonomous Car to Prevent Phantom Traffic Jams," www.wired.com, May 26, 2018.

* cited by examiner

*Primary Examiner* — Aniss Chad
*Assistant Examiner* — Stephanie T Su
(74) *Attorney, Agent, or Firm* — Seyfarth Shaw LLP

(57) ABSTRACT

A method for controlling traffic via a traffic control vehicle is provided. The method includes navigating to a location corresponding to a traffic incident. The method also includes providing a notification to other vehicles at the location to mitigate the traffic condition. The method further includes navigating away from the location after a period of time.

20 Claims, 8 Drawing Sheets

--Prior Art--

--Prior Art--

VEHICLES AS TRAFFIC CONTROL DEVICES

BACKGROUND

Field

Certain aspects of the present disclosure generally relate to traffic control devices and, more particularly, to a system and method for using a vehicle as a traffic control device.

Background

Conventional traffic control devices, such as stop signs, traffic lights, and turn arrows, are used to control traffic flow. These conventional traffic control devices may be located throughout a city and/or along thoroughfares. In most cases, a conventional traffic control device, such as a stop sign, is stationary. Due to costs and other considerations, conventional traffic control devices may not be located in some areas. For example, a rural area may have a limited number of traffic control devices. To improve traffic flow, it is desirable to dynamically adjust a number of traffic control devices in an area.

SUMMARY

In one aspect of the present disclosure, a method for controlling traffic via a traffic control vehicle is disclosed. The method includes navigating to a location corresponding to a traffic incident. The method also includes providing a notification to other vehicles at the location to mitigate the traffic incident. The method further includes navigating away from the location after a period of time.

In another aspect of the present disclosure, a non-transitory computer-readable medium with non-transitory program code recorded thereon is disclosed. The program code is for controlling traffic via a traffic control vehicle. The program code is executed by a processor and includes program code to navigate to a location corresponding to a traffic incident. The program code also includes program code to provide a notification to other vehicles at the location to mitigate the traffic incident. The program code further includes program code to navigate away from the location after a period of time.

Another aspect of the present disclosure is directed to an apparatus for controlling traffic via a traffic control vehicle. The apparatus having a memory and one or more processors coupled to the memory. The processor(s) is configured to navigate to a location corresponding to a traffic incident. The processor(s) is also configured to provide a notification to other vehicles at the location to mitigate the traffic incident. The processor(s) is further configured to navigating away from the location after a period of time.

This has outlined, rather broadly, the features and technical advantages of the present disclosure in order that the detailed description that follows may be better understood. Additional features and advantages of the present disclosure will be described below. It should be appreciated by those skilled in the art that this present disclosure may be readily utilized as a basis for modifying or designing other structures for carrying out the same purposes of the present disclosure. It should also be realized by those skilled in the art that such equivalent constructions do not depart from the teachings of the present disclosure as set forth in the appended claims. The novel features, which are believed to be characteristic of the present disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The features, nature, and advantages of the present disclosure will become more apparent from the detailed description set forth below when taken in conjunction with the drawings in which like reference characters identify correspondingly throughout.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts.

Conventional traffic control devices, such as traffic lights, are used to control traffic flow. In most cases, conventional traffic control devices are stationary. For example, a location of a conventional traffic light at an intersection does not change. During an event, such as a sporting event with increased traffic, temporary traffic control may be necessary. Human traffic officers and temporary traffic control devices may be dispatched to a location to provide temporary traffic control.

In most cases, for an event, the use of human traffic officers and temporary traffic control devices is pre-planned. A temporary traffic control device may include a vehicle or movable display board with a traffic control device, such as a traffic signal or a message board for providing information. For simplicity, human traffic officers and temporary traffic control devices may be referred to as temporary traffic control systems. The temporary traffic control systems may also be used on-demand to control traffic. For example, temporary traffic control systems may be dispatched to an accident location to control traffic. Still, there may be a delay in arriving at the accident location, thereby, causing delays in traffic mitigation.

The temporary traffic control systems may be dispatched to areas that do or do not include conventional traffic control devices. For example, during an event, the conventional traffic control devices may not be sufficient to control the flow of traffic. As another example, due to costs or limited traffic flow, a rural area may not include conventional traffic control devices.

To improve traffic control, it is desirable to dynamically adjust a number of temporary traffic control systems in an area. Aspects of the present disclosure are directed to improving traffic flow by equipping vehicles, such as personal use vehicles (e.g., privately owned vehicles) and/or ride-share vehicles, with traffic control systems. The traffic control systems may be a display that is dynamically adjusted to control traffic. For example, the display may be used as a traffic control light, a direction arrow, and/or a messaging system.

Figure 1A:
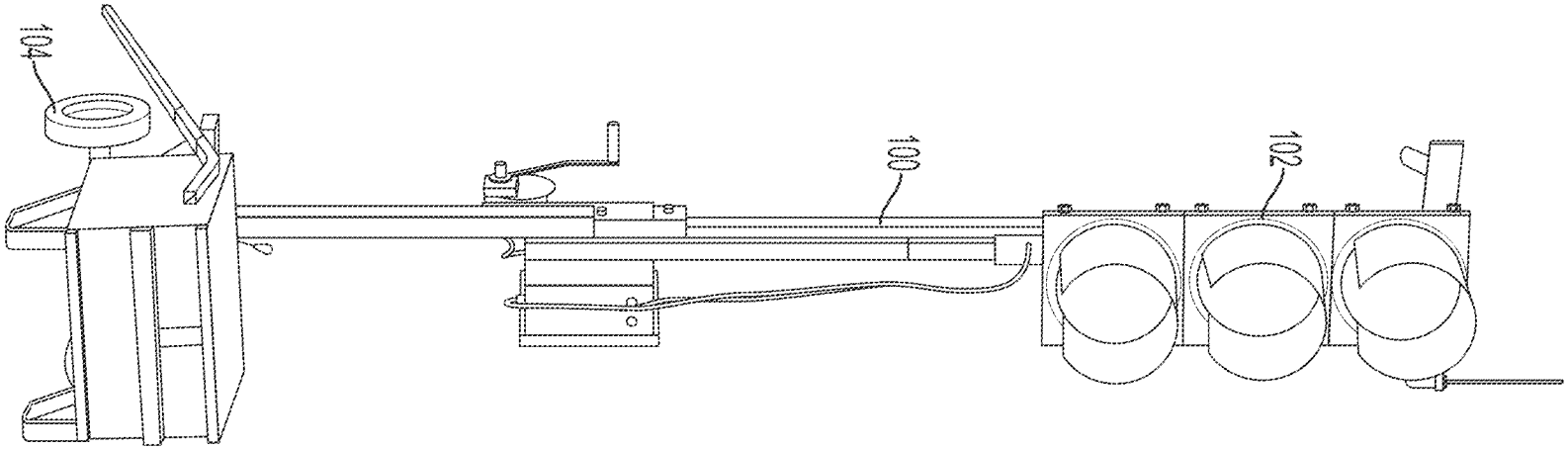
FIGS. 1A and 1B illustrate examples of conventional traffic control devices.

FIG. 1A illustrates an example of a conventional temporary traffic control system 100. As shown in FIG. 1A, the temporary traffic control system 100 includes a traffic signal 102 and a base with wheels 104, such that the temporary traffic control system 100 can be moved to an area where traffic control is needed. As discussed, traffic control may be needed at areas that include or do not include conventional traffic control devices. For example, the temporary traffic control system 100 may be placed at a site of a sporting event to provide additional traffic control. As another example, the temporary traffic control system 100 may be placed at a construction site or a rural area that does not include a conventional traffic control device.

Figure 1B:
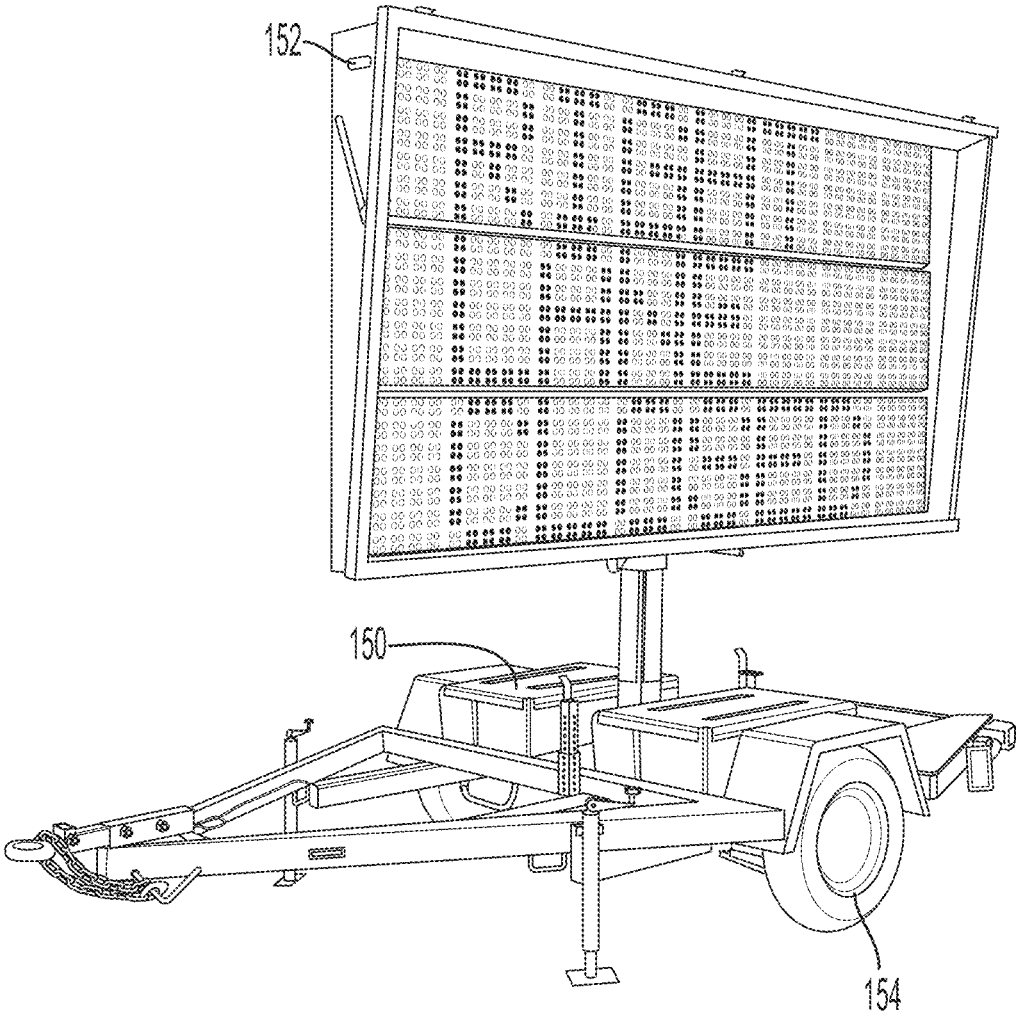

FIG. 1B illustrates another example of a conventional temporary traffic control system 150. As shown in FIG. 1B, the temporary traffic control system 150 includes message board 152 and a base with wheels 154, such that the temporary traffic control system 150 can be moved to an area where traffic control is needed. In this example, the message board 152 is used to provide messages to drivers, such as "right lane closed."

The conventional temporary traffic control systems 100, 150 may be stationed at a location for a period of time. For example, conventional temporary traffic control systems 100, 150 may be towed to an intersection and stationed at the intersection for a period of time. As another example, the conventional temporary traffic control systems 100, 150 may be integrated with a moving vehicle to move around an area.

Although the conventional temporary traffic control systems 100, 150 may mitigate traffic, it is difficult to dynamically allocate the conventional temporary traffic control systems 100, 150 to various areas as traffic situations occur. Additionally, the conventional temporary traffic control systems 100, 150 may be expensive. Therefore, areas with limited financial resources, such as rural areas, may not have access to the conventional temporary traffic control systems 100, 150.

Figure 2A:
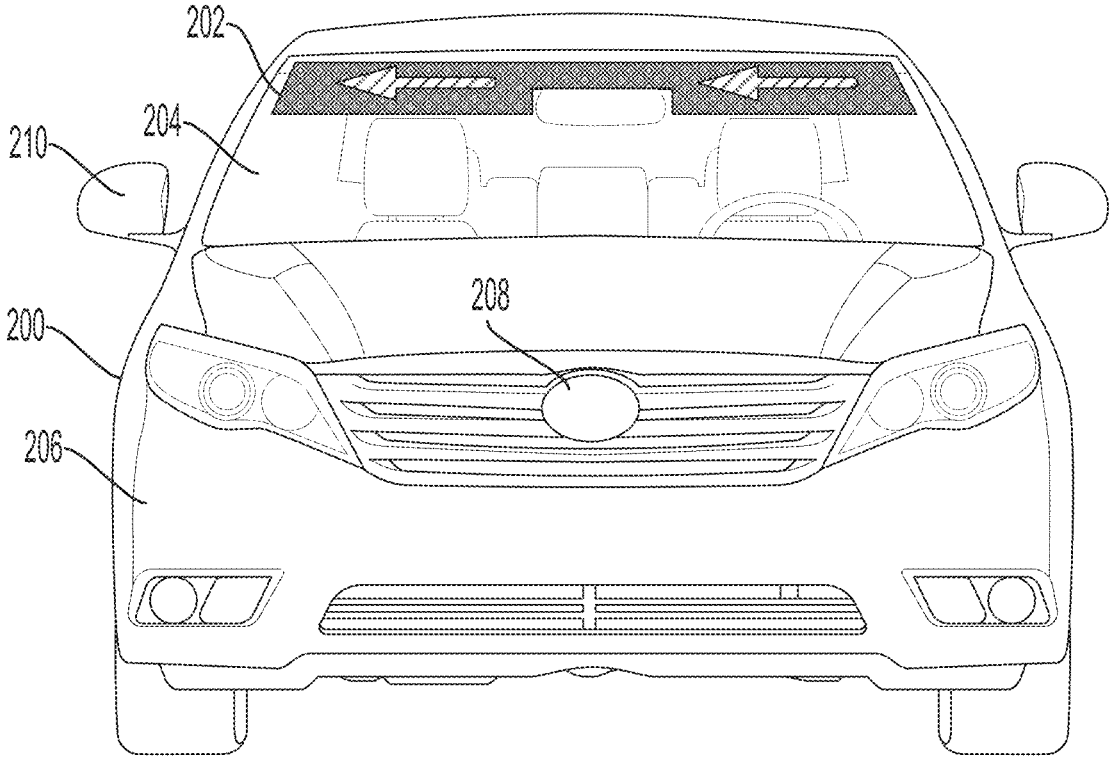
FIGS. 2A and 2B illustrate examples of a traffic control vehicle according to aspects of the present disclosure.

According to aspects of the present disclosure, a traffic control system is integrated with a vehicle, such as a personal use vehicle, government owned vehicle, and/or ride-share vehicle. The vehicle with the traffic control system may be referred to as a traffic control vehicle. FIG. 2A illustrates an example of a front view of a traffic control vehicle 200 according to aspects of the present disclosure.

As shown in FIG. 2A, a traffic control system 202 is integrated with a front windshield 204 of the traffic control vehicle 200. The traffic control system 202 may be integrated with a portion of the front windshield 204 so as not to block the driver's view. In addition to, or alternate from, the front windshield 204, the traffic control system 202 may be integrated with other portions of the traffic control vehicle 200. For example, the traffic control system 202 may be integrated with a bumper 206, a grill 208, and/or side mirrors 210.

The traffic control system 202 may include an interactive display, such as a liquid crystal display (LCD) screen or light emitting diode (LED) screen, that is powered by the traffic control vehicle 200. The traffic control system 202 may also include its own power source, such as a battery. The display may be adjusted based on the situation. For example, the display may be adapted to display traffic lights (e.g., red, green, and yellow lights), direction arrows, messages, and/or other information. As an example, as shown in FIG. 2A, the traffic control system 202 displays arrows on the front windshield 204 that may be used to notify other vehicles to move towards the direction shown by the arrows. The traffic control system 202 is not limited to a display, as the traffic control system 202 may be another type of device to communicate with other drivers and vehicles. For example, the traffic control system 202 may be an audio device, such as a siren, a light, or a sign.

Figure 2B:
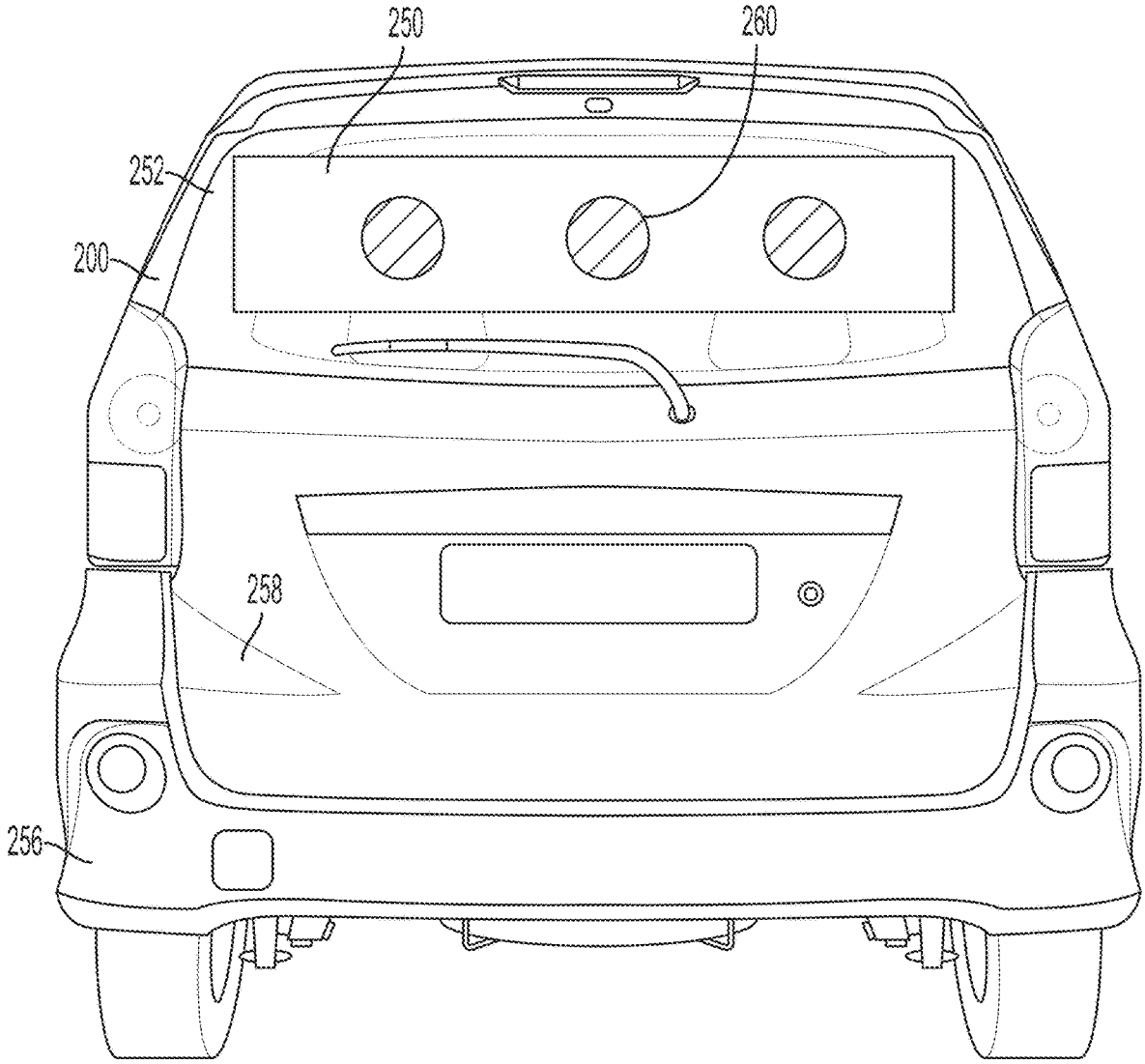

FIG. 2B illustrates an example of a rear view of the traffic control vehicle 200 according to aspects of the present disclosure. As shown in FIG. 2B, a traffic control system 250 is integrated with a rear windshield 252 of the traffic control vehicle 200. The traffic control system 250 may be integrated with a portion of the rear windshield 252. Alternatively, the traffic control system 250 may be integrated with an entire area of the rear windshield 252. In addition to, or alternate from, the rear windshield 252, the traffic control system 250 may be integrated with other portions of the traffic control vehicle 200. For example, the traffic control system 250 may be integrated with a rear bumper 256 or a hood/back portion 258 of the traffic control vehicle 200.

As discussed, the traffic control system 250 may include an interactive display that may be adjusted based on the situation. As an example, as shown in FIG. 2B, the traffic control system 250 displays a traffic signal with three lights 260. The lights 260 may be different colors or may be the same color based on the situation. For example, the lights 260 may be used to signal cars to slow down (e.g., flashing yellow lights) or the lights 260 may be used to control the flow of traffic (e.g., green, red, and yellow lights).

The display of the traffic control systems 202, 250 may be controlled via a traffic control center. The traffic control vehicle 200 and/or the traffic control systems 202, 250 may be in communication with the traffic control center via a communication channel, such as a cellular channel. The content displayed on the traffic control systems 202, 250 may also be controlled by a driver of the traffic control vehicle 200. In addition to controlling the content displayed on the traffic control systems 202, 250, the control system may control the traffic control vehicle 200 to drive to a location.

Transparency of the traffic control systems 202, 250 may be adjustable. That is, when a driver is driving the traffic control vehicle 200, the traffic control systems 202, 250 may be transparent. When the traffic control vehicle 200 is stopped at a location of a traffic incident, the traffic control systems 202, 250 may be opaque to increase visibility. The transparency of the traffic control systems 202, 250 may be controlled via an electrical current. For example, the traffic control systems 202, 250 may be composed of electrochromic glass.

In one configuration, a traffic control center monitors traffic using traffic monitoring devices, vehicle imaging/ranging devices, traffic modeling software, and/or other traffic monitoring systems. The traffic control center may determine a location where traffic control is needed, identify traffic control vehicles near the location, and/or transmit control signals to the identified traffic control vehicles.

Figure 3:
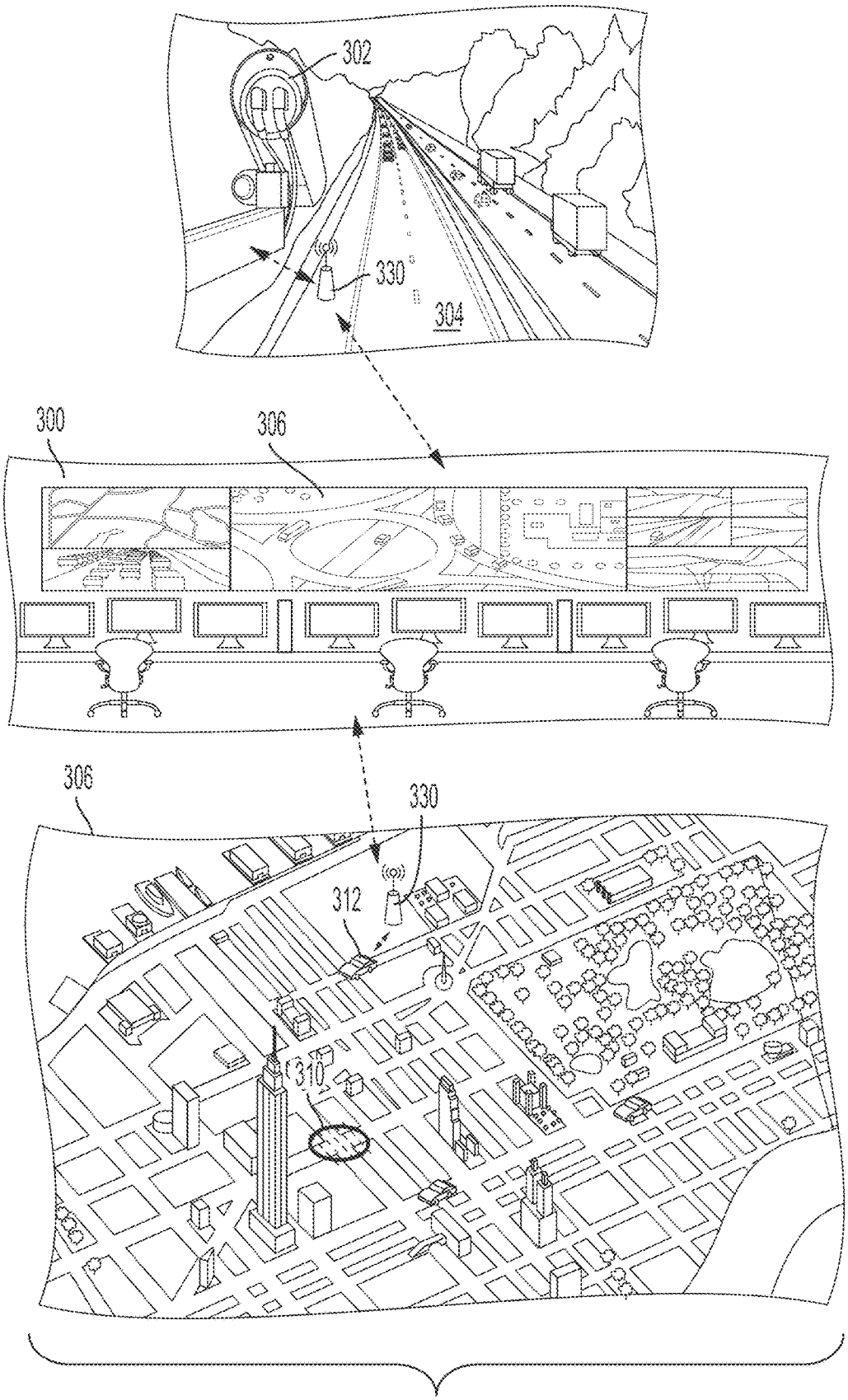
FIG. 3 illustrates an example of a traffic control system according to aspects of the present disclosure.

FIG. 3 illustrates a diagram of a traffic monitoring system according to aspects of the present disclosure. As shown in FIG. 3, a traffic control center 300 monitors traffic using traffic monitoring devices, vehicle imaging/ranging devices, traffic modeling software, and/or other traffic monitoring systems. The traffic control center 300 may be operated by humans and/or autonomously operated.

For example, as shown in FIG. 3, a sensor 302, such as a video camera or RADAR sensor, monitors traffic on a road 304. Multiple sensors 302 and other traffic monitoring systems may be used to monitor traffic in an area 306. In the current example, the traffic control center 300 receives multiple feeds 308 from different traffic monitoring systems via a communication system 330, such as a wireless communication system. A traffic situation 310 in the area 306 may be monitored from the multiple feeds 308. The traffic situation 310 may be due to an accident, an event (e.g., concert, sporting event, etc.), traffic congestion, or another situation that causes traffic.

In one example, traffic control devices in a location of the traffic situation 310 may not be capable of mitigating the traffic situation 310. For example, conventional traffic devices may not be capable of diverting traffic away from the traffic situation 310 or providing other types of traffic flow control to mitigate the traffic situation 310. As another example, the traffic situation 310 may be in a location without a traffic control device, such as a rural area or a residential area.

In response to identifying the traffic situation 310, the traffic control center 300 may identify traffic control vehicles 312 within a range of the traffic situation 310. The range may be pre-determined or based on a type of traffic situation 310. After identifying the traffic control vehicles 312, the traffic control center 300 may dispatch one or more traffic control vehicles 312 to the traffic situation 310. The number of dispatched traffic control vehicles 312 may be dependent on the type of traffic situation 310 or a solution to the traffic situation 310. The traffic control vehicles 312 may be in communication with the traffic control center 300 via the communication system 330. The communication system 330 used to communicate with the sensors 302 may be the same or different from the communication system 330 used to communicate with the traffic control vehicles 312.

For example, if the traffic situation 310 is caused by a damaged traffic light, the traffic control center 300 may dispatch one traffic control vehicle 312 for each damaged traffic light. As another example, if the traffic situation 310 is due to an accident, the traffic control center 300 may dispatch one traffic control vehicle 312 to a location that precedes the traffic situation 310, such that the traffic control vehicle 312 can divert traffic away from the traffic situation 310.

In one configuration, when a traffic control vehicle 312 is dispatched to the traffic situation 310, the traffic control vehicle 312 may autonomously navigate to a location designated by the traffic control center 300. The traffic control vehicle 312 may notify the driver of pending autonomous navigation. Alternatively, the traffic control vehicle 312 may direct the driver to manually drive the traffic control vehicle 312 to a location designated by the traffic control center 300.

The traffic control vehicle 312 may notify the traffic control center 300 when it has arrived at the designated location. The notification may be transmitted via a wireless communication channel, such as a cellular channel. Additionally, or alternatively, the traffic control center 300 may monitor the location of the dispatched traffic control vehicle 312 via location information, such as global position system (GPS) information. When the traffic control vehicle 312 has arrived at the designated location, the traffic control center 300 may control information displayed on one or more traffic control devices of the traffic control vehicle 312. The information displayed on the one or more traffic control devices may be used to mitigate the traffic situation 310.

Figure 4:
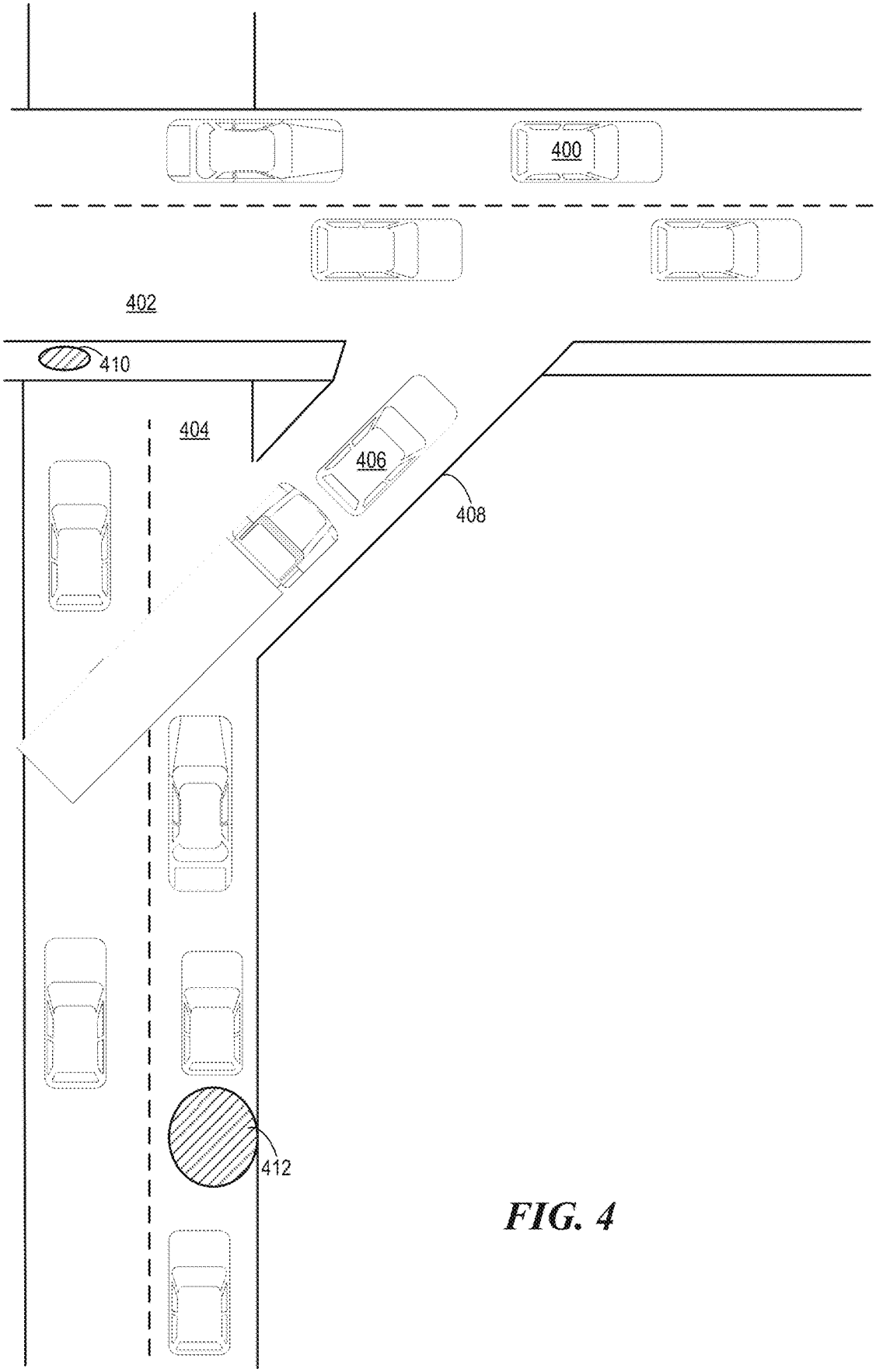
FIG. 4 illustrates an example of a traffic incident according to aspects of the present disclosure.

FIG. 4 illustrates an example of mitigating traffic via one or more traffic control vehicles according to aspects of the present disclosure. As shown in FIG. 4, vehicles 400 may be traveling on a freeway 402. Other vehicles 406 may be traveling on a road 404. In this example, the vehicles 400 on the freeway 402 travel at a higher speed in comparison to vehicles 406 entering the freeway 402 via an onramp 408. Due to the differences in speed, it may be difficult for a vehicle 406 to merge onto the freeway 402.

As shown in FIG. 4, multiple vehicles 406 are on the onramp 408. Because it is difficult for the vehicles 406 to merge onto the freeway 402, traffic is backed up on the onramp 408. The backed up traffic on the onramp 408 causes traffic on the road 404. The traffic on the road 404 may cause delays and/or accidents. A traffic monitoring center may identify the backup and control one or more traffic control vehicles to mitigate the backup.

In this example, the backup may be mitigated by having vehicles 400 on the freeway 402 slow down and/or having vehicles 406 on the road 404 avoid the onramp 408. In one example, the traffic monitoring center identifies a first traffic control vehicle within a range of a merge point between the freeway 402 and the onramp 408. The traffic monitoring center may control the traffic control vehicle to pull to a first location 410. In this example, the first location 410 is a certain distance before the merge point on a shoulder of the freeway 402.

Upon arriving at the first location 410, the traffic monitoring center may control a traffic control device of the first traffic control vehicle to signal the vehicles 400 on the freeway 402 to slow down. The signal may include flashing yellow lights, a hazard signal, text (e.g., "slow down"), or another type of signal. The traffic monitoring center may control the traffic control device prior to or upon the traffic control vehicle's arrival at a designated location.

As another example, the traffic monitoring center identifies a second traffic control vehicle and controls the second traffic control vehicle to drive to a second location 412 before the onramp 408. Upon arriving at the second location 412, the traffic monitoring center may control a traffic control device of the second traffic control vehicle to signal the vehicles 406 on the road 404 to avoid the onramp 408. The signal may include arrows that notify other drivers to change lanes, text (e.g., "lane closed"), or another type of signal.

Aspects of the present disclosure are not limited to controlling traffic on a freeway. Other types of traffic control are contemplated. As discussed, the traffic control vehicles may be used in areas with or without traffic control devices. For example, during peak traffic, the traffic control vehicles may be used to display traffic signals at an intersection that only includes stop signs. The traffic signals may improve traffic flow during peak traffic.

As another example, a traffic control vehicle may control traffic near an oversized vehicle. In this example, the traffic control center may control the traffic control vehicle to move behind the oversized vehicle, slow down, and activate the vehicle's traffic control device to cause other vehicles to slow down and/or move around the oversized vehicle. In yet another example, the traffic control vehicle may be used to stop or divert traffic on a particular road. For example, the traffic control vehicle may divert traffic from a parade route, divert traffic from the path of an emergency vehicle, divert traffic from a funeral procession, and/or divert traffic away from pedestrians. Specifically, the traffic control vehicle may be controlled to navigate to a location and activate signage signaling other cars to stop or turn onto a different road.

The traffic control vehicles may be occupied or unoccupied. Additionally, the traffic control vehicles may be autonomous or semi-autonomous vehicles. To prevent driver inconvenience, a traffic control vehicle may remain at a designated location for a time period until it is replaced by another traffic control vehicle. This process is repeated until the traffic situation is alleviated. In the event that multiple traffic control vehicles are present on the roads, the traffic control vehicles may eliminate the need for conventional traffic control devices (e.g., traffic signals, stop signs, etc.).

As previously discussed, the traffic control vehicles may be government owned vehicles, personally owned vehicles, and/or ride-share vehicles. For example, government employees may be directed to operate the traffic control vehicles in an area until one or more traffic control vehicles are externally controlled to direct traffic flow. The external controls may cause the traffic control vehicle to stop at a certain location. That is, the external controls may override manual operation. The external control may also cause the traffic control vehicle to display the appropriate signage.

In another example, the traffic control vehicle is driven by a private citizen. That is, the private citizen may register their own private vehicle as a traffic control vehicle (e.g., private traffic control vehicle). If the private traffic control vehicle is in an area where traffic control is needed, the private traffic control vehicle may warn the driver of pending traffic flow control. The private traffic control vehicle may then be externally controlled to navigate to a location and display signage to control traffic flow.

Figure 5:
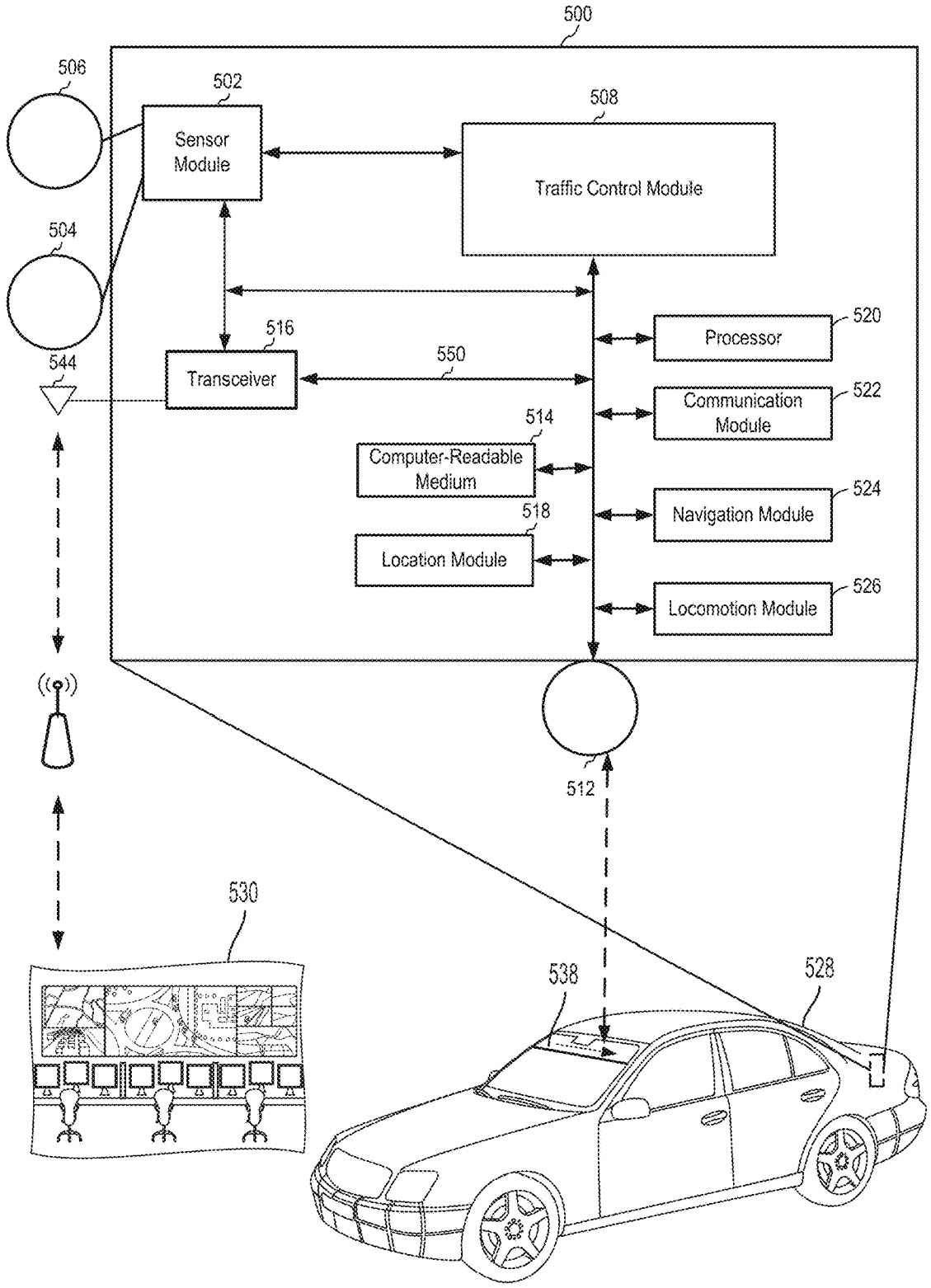
FIG. 5 is a diagram illustrating an example of a hardware implementation for an autonomous vehicle navigation system according to aspects of the present disclosure.

FIG. 5 is a diagram illustrating an example of a hardware implementation for a traffic control system 500, according to aspects of the present disclosure. The traffic control system 500 may be a component of a vehicle, a robotic device, or another device. For example, as shown in FIG. 5, the traffic control system 500 is a component of a traffic control vehicle 528. Aspects of the present disclosure are not limited to the traffic control vehicle 528, as other devices, such as a bus, boat, drone, or robot, are also contemplated for using the traffic control system 500. The traffic control vehicle 528 may be autonomous or semi-autonomous.

The traffic control system 500 may be implemented with a bus architecture, represented generally by a bus 550. The bus 550 may include any number of interconnecting buses and bridges depending on the specific application of the traffic control system 500 and the overall design constraints. The bus 550 links together various circuits including one or more processors and/or hardware modules, represented by a processor 520, a communication module 522, a location module 518, a sensor module 502, a locomotion module 526, a navigation module 524, a computer-readable medium 514, a traffic control module 508, and a traffic device controller 512. The bus 550 may also link various other circuits such as timing sources, peripherals, voltage regulators, and power management circuits, which are well known in the art, and therefore, will not be described any further.

The traffic control system 500 includes a transceiver 516 coupled to the processor 520, the sensor module 502, the traffic control module 508, the traffic device controller 512, the communication module 522, the location module 518, the locomotion module 526, the navigation module 524, and the computer-readable medium 514. The transceiver 516 is coupled to an antenna 544. The transceiver 516 communicates with various other devices over a transmission medium. For example, the transceiver 516 may receive commands via transmissions from a user or a remote device. As another example, the transceiver 516 may transmit driving statistics and information from the traffic control module 508 to a server (not shown).

The traffic control system 500 includes the processor 520 coupled to the computer-readable medium 514. The processor 520 performs processing, including the execution of software stored on the computer-readable medium 514 providing functionality according to the disclosure. The software, when executed by the processor 520, causes the traffic control system 500 to perform the various functions described for a particular device, such as the traffic control vehicle 528, or any of the modules 502, 514, 516, 518, 520, 522, 524, 526. The computer-readable medium 514 may also be used for storing data that is manipulated by the processor 520 when executing the software.

The sensor module 502 may be used to obtain measurements via different sensors, such as a first sensor 506 and a second sensor 504. The first sensor 506 may be a vision sensor, such as a stereoscopic camera or a red-green-blue (RGB) camera, for capturing 2D images. The second sensor 504 may be a ranging sensor, such as a light detection and ranging (LIDAR) sensor or a radio detection and ranging (RADAR) sensor. Of course, aspects of the present disclosure are not limited to the aforementioned sensors as other types of sensors, such as, for example, thermal, sonar, and/or lasers are also contemplated for either of the sensors 504, 506. The measurements of the first sensor 506 and the second sensor 504 may be processed by one or more of the processor 520, the sensor module 502, the communication module 522, the location module 518, the locomotion module 526, and the navigation module 524, in conjunction with the computer-readable medium 514, to implement the functionality described herein. In one configuration, the data captured by the first sensor 506 and the second sensor 504 may be transmitted to an external device via the transceiver 516. The first sensor 506 and the second sensor 504 may be coupled to the traffic control vehicle 528 or may be in communication with the traffic control vehicle 528.

The location module 518 may be used to determine a location of the traffic control vehicle 528. For example, the location module 518 may use a global positioning system (GPS) to determine the location of the traffic control vehicle 528. The communication module 522 may be used to facilitate communications via the transceiver 516. For example, the communication module 522 may be configured to provide communication capabilities via different wireless protocols, such as WiFi, long term evolution (LTE), 4G, etc. The communication module 522 may also be used to communicate with other components of the traffic control vehicle 528 that are not modules of the route planning system 500.

The locomotion module 526 may be used to facilitate locomotion of the traffic control vehicle 528. As an example, the locomotion module 526 may control movement of the wheels. As another example, the locomotion module 526 may be in communication with a power source of the traffic control vehicle 528, such as an engine or batteries. Of course, aspects of the present disclosure are not limited to providing locomotion via wheels and are contemplated for other types of components for providing locomotion, such as propellers, treads, fins, and/or jet engines.

The traffic control system 500 also includes the navigation module 524 for planning a route or controlling the locomotion of the traffic control vehicle 528, via the locomotion module 526. The navigation module 524 may be in communication with the traffic control module 508, the traffic device controller 512, the sensor module 502, the transceiver 516, the processor 520, the communication module 522, the location module 518, the locomotion module 526, the navigation module 524, and the computer-readable medium 514. In one configuration, the navigation module 524 overrides the user input. The modules may be software modules running in the processor 520, resident/stored in the computer-readable medium 514, one or more hardware modules coupled to the processor 520, or some combination thereof.

According to aspects of the present disclosure, the traffic control system 500 includes a traffic control module 508 in communication with the navigation module 524, the traffic device controller 512, the sensor module 502, the transceiver 516, the processor 520, the communication module 522, the location module 518, the locomotion module 526, the navigation module 524, and the computer-readable medium 514. The traffic control module 508 may be in communication with a traffic control center 530 via the transceiver 516 and/or the communication module 522.

In one configuration, the traffic control center 530 instructs the traffic control module 508 to navigate the traffic control vehicle 528 to a location. In response to the instructions, the traffic control module 508 instructs the navigation module 524 to control the locomotion module 526 to autonomously navigate the traffic control vehicle 528 to the location. In another configuration, in response to the instructions, the traffic control module 508 instructs the driver to manually navigate the traffic control vehicle 528 to the location. A notification system, such as a display screen on a dashboard, of the traffic control vehicle 528 may provide the instructions to the driver. The navigation module 524 may provide the traffic control vehicle's 528 location to the traffic control center 530.

The traffic control center 530 may also instruct the traffic control module 508 to leave the location after a time period. As discussed, to reduce driver discomfort, each traffic control vehicle 528 may be at a location for a time period before being replaced by another traffic control vehicle 528. The traffic control center 530 may monitor the time period and instruct the traffic control module 508 to leave the location when the time period is equal to or greater than a threshold. In response to the instructions to leave, the traffic control module 508 instructs the navigation module 524 to control the locomotion module 526 to autonomously navigate the traffic control vehicle 528 to leave the location. In another configuration, in response to the instructions, the traffic control module 508 instructs the driver to manually navigate the traffic control vehicle 528 to leave the location.

The traffic control center 530 may also instruct the traffic control module 508 to control information displayed on one or more traffic control systems 538. For simplicity, FIG. 5 illustrates one traffic control system 538 integrated with the traffic control vehicle. The traffic control module 508 may control each traffic control system 538 via a traffic device controller 512. The traffic device controller 512 may activate or deactivate each traffic control system 538. Furthermore, the traffic device controller 512 may control the information displayed on each traffic control system 538. The traffic device controller 512 may be configured based on a type of traffic control system 538 integrated with the traffic control vehicle 528. As discussed, the traffic control system 538 may be a display screen, a sign, lights, an audio system, or other system used to provide information to other drivers and/or vehicles. The traffic control vehicle 528 may include a combination of different types of traffic control systems 538.

Figure 6:
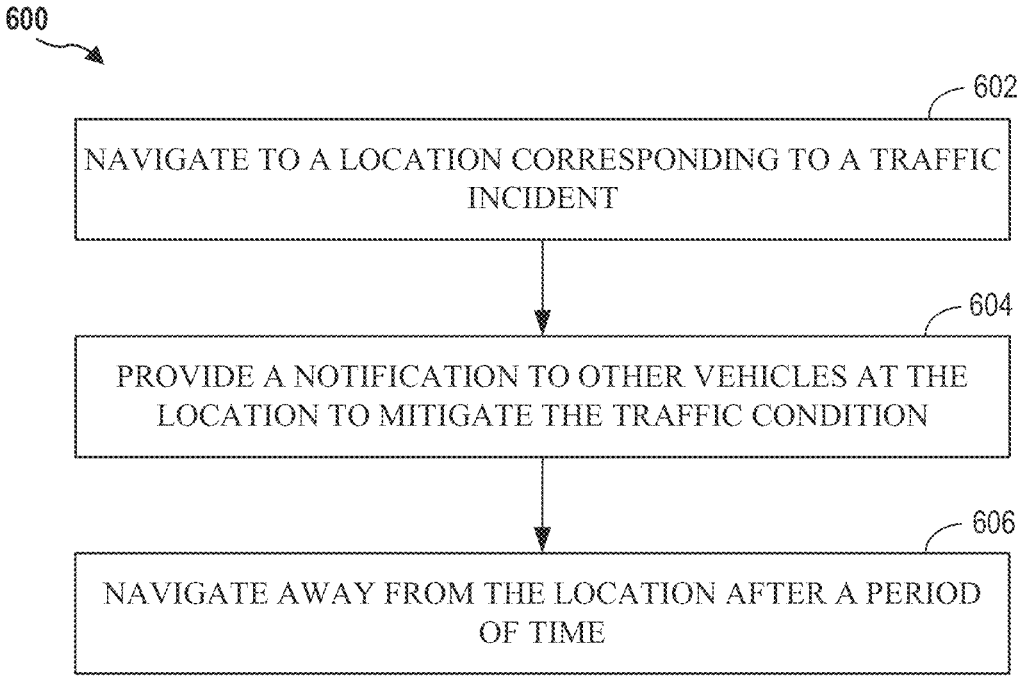
FIG. 6 illustrates a flow diagram for controlling traffic with a traffic control vehicle according to aspects of the present disclosure.

FIG. 6 illustrates a method 600 for controlling traffic via a traffic control vehicle according to an aspect of the present disclosure. As shown in FIG. 6, at block 602 a traffic control vehicle navigates to a location corresponding to a traffic incident. The traffic incident may be an accident, an event, congestion, or other situation that causes traffic. The location may be a location at the traffic incident, such as an intersection, or a location within a range of the traffic incident. Additionally, the location may or may not include conventional traffic control devices, such as stop signs or traffic signals.

The traffic control vehicle may navigate to the location in response to an instruction received from a traffic control center that is remote from the location. The traffic control center monitors traffic in an area, such as a city, based on information provided via one or more sources, such as traffic monitoring cameras, vehicle sensors, road sensors, and/or other sources of information. Upon detecting a traffic incident, the traffic control center identifies one or more traffic control vehicles within a range of the traffic incident and dispatches the traffic vehicle(s) to the traffic incident.

The traffic control vehicle may be an autonomous vehicle or a semi-autonomous vehicle. In one configuration, the traffic control vehicle autonomously navigates to the location. In this configuration, the traffic control vehicle may override manual control of the traffic control vehicle when navigating to the location. In another configuration, the traffic control vehicle may instruct the driver to navigate to the location.

Upon arriving at the location, at block 604, the traffic control vehicle provides a notification to other vehicles at the location to mitigate the traffic incident. The notification may be a visual output and/or an audio output provided via one or more traffic control systems of the traffic control vehicle. For example, a traffic control system may be a display, such as an LED or LCD display integrated with a portion of the traffic control vehicle.

At block 606, the traffic control vehicle navigates away from the location after a period of time. The traffic control vehicle navigates away from the location in response to an instruction received from the traffic control center. That is, to reduce passenger discomfort, the traffic control vehicle may remain at a location for a period of time. After the period of time, the traffic control vehicle is replaced by another traffic control vehicle. The process of replacing traffic control vehicles is repeated until the traffic incident is mitigated. In some cases, the traffic control vehicles may replace conventional traffic control devices. In this situation, the process of replacing traffic control vehicles may be repeated indefinitely or during times when traffic levels are greater than a threshold.

Based on the teachings, one skilled in the art should appreciate that the scope of the present disclosure is intended to cover any aspect of the present disclosure, whether implemented independently of or combined with any other aspect of the present disclosure. For example, an apparatus may be implemented or a method may be practiced using any number of the aspects set forth. In addition, the scope of the present disclosure is intended to cover such an apparatus or method practiced using other structure, functionality, or structure and functionality in addition to, or other than the various aspects of the present disclosure set forth. It should be understood that any aspect of the present disclosure may be embodied by one or more elements of a claim.

The word "exemplary" is used herein to mean "serving as an example, instance, or illustration." Any aspect described herein as "exemplary" is not necessarily to be construed as preferred or advantageous over other aspects.

Although particular aspects are described herein, many variations and permutations of these aspects fall within the scope of the present disclosure. Although some benefits and advantages of the preferred aspects are mentioned, the scope of the present disclosure is not intended to be limited to particular benefits, uses or objectives. Rather, aspects of the present disclosure are intended to be broadly applicable to different technologies, system configurations, networks and protocols, some of which are illustrated by way of example in the figures and in the following description of the preferred aspects. The detailed description and drawings are merely illustrative of the present disclosure rather than limiting, the scope of the present disclosure being defined by the appended claims and equivalents thereof.

As used herein, the term "determining" encompasses a wide variety of actions. For example, "determining" may include calculating, computing, processing, deriving, investigating, looking up (e.g., looking up in a table, a database or another data structure), ascertaining and the like. Additionally, "determining" may include receiving (e.g., receiving information), accessing (e.g., accessing data in a memory) and the like. Furthermore, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logical blocks, modules and circuits described in connection with the present disclosure may be implemented or performed with a processor configured to perform the functions discussed in the present disclosure. The processor may be a neural network processor, a digital signal processor (DSP), an application specific integrated circuit (ASIC), a field programmable gate array signal (FPGA) or other programmable logic device (PLD), discrete gate or transistor logic, discrete hardware components or any combination thereof designed to perform the functions described herein. The processor may be a microprocessor, controller, microcontroller, or state machine specially configured as described herein. A processor may also be implemented as a combination of computing devices, e.g., a combination of a DSP and a microprocessor, a plurality of microprocessors, one or more microprocessors in conjunction with a DSP core, or such other special configuration, as described herein.

The steps of a method or algorithm described in connection with the present disclosure may be embodied directly in hardware, in a software module executed by a processor, or in a combination of the two. A software module may reside in storage or machine readable medium, including random access memory (RAM), read only memory (ROM), flash memory, erasable programmable read-only memory (EPROM), electrically erasable programmable read-only memory (EEPROM), registers, a hard disk, a removable disk, a CD-ROM or other optical disk storage, magnetic disk storage or other magnetic storage devices, or any other medium that can be used to carry or store desired program code in the form of instructions or data structures and that can be accessed by a computer. A software module may comprise a single instruction, or many instructions, and may be distributed over several different code segments, among different programs, and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in hardware, an example hardware configuration may comprise a processing system in a device. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to connect a network adapter, among other things, to the processing system via the bus. The network adapter may be used to implement signal processing functions. For certain aspects, a user interface (e.g., keypad, display, mouse, joystick, etc.) may also be connected to the bus. The bus may also link various other circuits such as timing sources, peripherals, voltage regulators, power management circuits, and the like, which are well known in the art, and therefore, will not be described any further.

The processor may be responsible for managing the bus and processing, including the execution of software stored on the machine-readable media. Software shall be construed to mean instructions, data, or any combination thereof, whether referred to as software, firmware, middleware, microcode, hardware description language, or otherwise.

In a hardware implementation, the machine-readable media may be part of the processing system separate from the processor. However, as those skilled in the art will readily appreciate, the machine-readable media, or any portion thereof, may be external to the processing system. By way of example, the machine-readable media may include a transmission line, a carrier wave modulated by data, and/or a computer product separate from the device, all which may be accessed by the processor through the bus interface. Alternatively, or in addition, the machine-readable media, or any portion thereof, may be integrated into the processor, such as the case may be with cache and/or specialized register files. Although the various components discussed may be described as having a specific location, such as a local component, they may also be configured in various ways, such as certain components being configured as part of a distributed computing system.

The processing system may be configured with one or more microprocessors providing the processor functionality and external memory providing at least a portion of the machine-readable media, all linked together with other supporting circuitry through an external bus architecture. Alternatively, the processing system may comprise one or more neuromorphic processors for implementing the neuron models and models of neural systems described herein. As another alternative, the processing system may be implemented with an application specific integrated circuit (ASIC) with the processor, the bus interface, the user interface, supporting circuitry, and at least a portion of the machine-readable media integrated into a single chip, or with one or more field programmable gate arrays (FPGAs), programmable logic devices (PLDs), controllers, state machines, gated logic, discrete hardware components, or any other suitable circuitry, or any combination of circuits that can perform the various functions described throughout this present disclosure. Those skilled in the art will recognize how best to implement the described functionality for the processing system depending on the particular application and the overall design constraints imposed on the overall system.

The machine-readable media may comprise a number of software modules. The software modules may include a transmission module and a receiving module. Each software module may reside in a single storage device or be distributed across multiple storage devices. By way of example, a software module may be loaded into RAM from a hard drive when a triggering event occurs. During execution of the software module, the processor may load some of the instructions into cache to increase access speed. One or more cache lines may then be loaded into a special purpose register file for execution by the processor. When referring to the functionality of a software module below, it will be understood that such functionality is implemented by the processor when executing instructions from that software module. Furthermore, it should be appreciated that aspects of the present disclosure result in improvements to the functioning of the processor, computer, machine, or other system implementing such aspects.

If implemented in software, the functions may be stored or transmitted over as one or more instructions or code on a computer-readable medium. Computer-readable media include both computer storage media and communication media including any storage medium that facilitates transfer of a computer program from one place to another. Additionally, any connection is properly termed a computer-readable medium. For example, if the software is transmitted from a website, server, or other remote source using a coaxial cable, fiber optic cable, twisted pair, digital subscriber line (DSL), or wireless technologies such as infrared (IR), radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray® disc where disks usually reproduce data magnetically, while discs reproduce data optically with lasers. Thus, in some aspects computer-readable media may comprise non-transitory computer-readable media (e.g., tangible media). In addition, for other aspects computer-readable media may comprise transitory computer-readable media (e.g., a signal). Combinations of the above should also be included within the scope of computer-readable media.

Thus, certain aspects may comprise a computer program product for performing the operations presented herein. For example, such a computer program product may comprise a computer-readable medium having instructions stored (and/or encoded) thereon, the instructions being executable by one or more processors to perform the operations described herein. For certain aspects, the computer program product may include packaging material.

Further, it should be appreciated that modules and/or other appropriate means for performing the methods and techniques described herein can be downloaded and/or otherwise obtained by a user terminal and/or base station as applicable. For example, such a device can be coupled to a server to facilitate the transfer of means for performing the methods described herein. Alternatively, various methods described herein can be provided via storage means, such that a user terminal and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A method for controlling traffic performed by a traffic control vehicle, comprising:

autonomously navigating to a location corresponding to a traffic incident;

transmitting, to a traffic control system, a notification indicating arrival of the traffic control vehicle at the location corresponding to the traffic incident;

receiving, from the traffic control system, first content to be displayed via a first notification device integrated with the traffic control vehicle;

increasing an opacity of the first notification device based on the traffic control vehicle arriving at the location, the first notification device being transparent while autonomously navigating to the location;

displaying, via the first notification device, the first content received from the traffic control system, to other vehicles at the location; and autonomously navigating away from the location after a period of time.

2. The method of claim 1, further comprising autonomously navigating to the location in response to an instruction received from a remote device.

3. The method of claim 1, further comprising overriding manual control of the traffic control vehicle when autonomously navigating to the location.

4. The method of claim 1, further comprising receiving second content for a second notification device integrated with the traffic control vehicle, the second notification device provides at least one of a visual output, an audio output, or a combination thereof.

5. The method of claim 1, further comprising autonomously navigating away from the location in response to an instruction received from a remote device after the period of time.

6. The method of claim 1, in which the traffic control vehicle is replaced with another traffic control vehicle after autonomously navigating away from the location.

7. The method of claim 1, in which the first notification device is integrated with a front windshield or a rear windshield of the traffic control vehicle.

8. A traffic control vehicle for controlling traffic, comprising:

a memory;

a processor coupled to the memory; and instructions stored in the memory and operable, when executed by the processor, to cause the traffic control vehicle:

to autonomously navigate to a location corresponding to a traffic incident;

to transmit, to a traffic control system, a notification indicating arrival of the traffic control vehicle at the location corresponding to the traffic incident;

to receive, from the traffic control system, first content to be displayed via a first notification device integrated with the traffic control vehicle;

to increase an opacity of the first notification device based on the traffic control vehicle arriving at the location, the first notification device being transparent while autonomously navigating to the location to display, via the first notification device, the first content received from the traffic control system, to other vehicles at the location; and to autonomously navigate away from the location after a period of time.

9. The traffic control vehicle of claim 8, in which execution of the instructions further cause the traffic control vehicle to autonomously navigate to the location in response to an instruction received from a remote device.

10. The traffic control vehicle of claim 8, in which execution of the instructions further cause the traffic control vehicle to override manual control of the traffic control vehicle when autonomously navigating to the location.

11. The traffic control vehicle of claim 8, in which execution of the instructions further cause the traffic control vehicle to receive second content for a second notification device integrated with the traffic control vehicle, the second notification device provides at least one of a visual output, an audio output, or a combination thereof.

12. The traffic control vehicle of claim 8, in which execution of the instructions further cause the traffic control vehicle to autonomously navigate away from the location in response to an instruction received from a remote device after the period of time.

13. The traffic control vehicle of claim 8, in which the traffic control vehicle is replaced with another traffic control vehicle after autonomously navigating away from the location.

14. The traffic control vehicle of claim 8, in which the first notification device is integrated with a front windshield or a rear windshield of the traffic control vehicle.

15. A non-transitory computer-readable medium having program code recorded thereon for controlling a traffic control vehicle, comprising:

program code to autonomously navigate to a location corresponding to a traffic incident;

program code to transmit, to a traffic control system, a notification indicating arrival of the traffic control vehicle at the location corresponding to the traffic incident;

program code to receive, from the traffic control system, first content to be displayed via a first notification device integrated with the traffic control vehicle;

program code to increase an opacity of the first notification device based on the traffic control vehicle arriving at the location, the first notification device being transparent while autonomously navigating to the location;

program code to display, via the first notification device, the first content received from the traffic control system, to other vehicles at the location; and program code to autonomously navigate away from the location after a period of time.

16. The non-transitory computer-readable medium of claim 15, in which the program code further comprises program code to navigate to the location in response to an instruction received from a remote device.

17. The non-transitory computer-readable medium of claim 15, in which the program code further comprises program code to override manual control of the traffic control vehicle when autonomously navigating to the location.

18. The non-transitory computer-readable medium of claim 15, in which the program code further comprises program code to receive second content for a second notification device integrated with the traffic control vehicle, the second notification device provides at least one of a visual output, an audio output, or a combination thereof.

19. The non-transitory computer-readable medium of claim 15, in which the program code further comprises program code to autonomously navigate away from the location in response to an instruction received from a remote device after the period of time.

20. The non-transitory computer-readable medium of claim 15, in which the first notification device is integrated with a front windshield or a rear windshield of the traffic control vehicle.

* * * * *